United States Patent [19]

Knappstein

[11] 4,176,011

[45] Nov. 27, 1979

[54] METHOD FOR OPERATING COKE OVEN CHAMBERS IN CONNECTION WITH A PREDRYING PLANT FOR THE COAL

[75] Inventor: Johannes Knappstein, Recklinghausen, Fed. Rep. of Germany

[73] Assignee: Firma Carl Still, Fed. Rep. of Germany

[21] Appl. No.: 842,100

[22] Filed: Oct. 14, 1977

[30] Foreign Application Priority Data

Oct. 19, 1976 [DE] Fed. Rep. of Germany ..... 2647079

[51] Int. Cl.[2] ..... C10B 27/00; C10B 57/10

[52] U.S. Cl. ..... 201/40; 201/41; 202/261; 202/262

[58] Field of Search ..... 201/39, 40, 41; 202/227, 228, 254, 261, 262, 263

[56] References Cited

U.S. PATENT DOCUMENTS

| | | | |
|---|---|---|---|
| 3,580,815 | 5/1971 | Tucker | 202/254 X |
| 3,623,959 | 11/1971 | Knappstein | 201/40 |
| 3,647,053 | 3/1972 | Palumbo | 201/40 X |
| 3,697,381 | 10/1972 | Kemmetmueller | 202/263 X |
| 3,888,742 | 6/1975 | Kemmetmueller | 202/228 X |
| 4,030,983 | 6/1977 | Beck et al. | 201/40 X |
| 4,053,364 | 10/1977 | Poersch et al. | 202/228 X |

*Primary Examiner*—Arnold Turk
*Attorney, Agent, or Firm*—McGlew and Tuttle

[57] ABSTRACT

Method of operating a coke oven battery arranged in a battery in connection with a predrying or preheating plant for the coal to be coked comprises predrying and preheating coke oven charge moist coal by bringing it into contact with a circulated current of hot inert gas to remove water from the charge with the inert gas comprising a gas containing only a small amount of oxygen and a remainder comprising nitrogen, carbon dioxide and steam, charging the preheated and predried coal into a coke oven, directing the coke oven gases generated in the oven out through an offtake, and adding an amount of steam corresponding approximately to the amount of water removed from the charge coal during the predrying and preheating to the coke oven gases in the gas offtake. The apparatus includes a closed circuit in which steam is added to a line and then superheated by a heater and is directed into a secondary flash heater. Fine coal is delivered in a moist condition to a primary flash dryer through which the steam is directed after passing through the preliminary flash dryer and coal treated in the primary flash dryer is directed through a separator and then to the secondary flash heater and out of the flash heater to a conduit for charging it into the coke oven chamber. The steam is contained in a closed cycle and after passing through the preliminary flash heater and the primary flash dryer it is circulated after separation back to the heater. Any excess steam is removed and passed through a precipitator.

6 Claims, 2 Drawing Figures

METHOD FOR OPERATING COKE OVEN CHAMBERS IN CONNECTION WITH A PREDRYING PLANT FOR THE COAL

BACKGROUND OF THE INVENTION

Field of the Invention

This invention relates in general to a method and apparatus for predrying coal which is to be infused in a coke oven battery, particularly to a new and useful method for operating coke batteries in association with a predrying or preheating plant for the coal to be coked and wherein the moist charge coal is preheated and predried by bringing it into contact with a circulated amount of hot inert gas to remove water from the charge coal and wherein the inert gas comprises a gas containing only a small amount of oxygen and a remainder comprising nitrogen, carbon dioxide and steam and wherein the preheated and predried coal is charged into the coke oven and the coke oven gases which are generated are directed out through an offtake and an amount of steam approximately equal to the amount of water removed from the charge coal is added to the coke oven gases in the offtake.

The predrying or preheating of coking coals has prevailed in the coke industry quite generally, because such an operation makes it possible to produce good metallurgical coke even from coals which, without this preliminary statement, would not give a usable coke, which means that the range of the types of coal yielding a metallurgical coke of satisfactory quality is thereby enlarged.

In addition, the preliminary heating of coke coal reduces the time necessary for carbonization by the period of time needed for vaporizing the moisture adhering to the coke coal, which period may amount of a fourth or fifth or even more of the entire coking time. In this way, the high expenses of the preheating operation are partly compensated.

SUMMARY OF THE INVENTION

The present invention relates to a method of operating coke oven chambers arranged in a battery, in connection with a predrying or preheating plant for the coal to be carbonized, as well as to a device for carrying out the method, in which the moist coking coal is brought into contact with a circulated stream of hot inert gas which may be a gas containing only little oxygen and, as for the rest, consists of nitrogen, carbon dioxide, and steam, thus, for example, a combustion gas from petroleum, natural gas, low hydrocarbons, or coal.

In this process, for heating the circulated gas, the waste heat of the coke to be quenched may be used, and for quenching the coke, an also circulated inert gas may be employed and finally, the predrying circuit and the quenching circuit may be united to a single circuit (German Offenlegungsschrift No. 2,415,758).

The coal may be dried in one or several stages. Also, the coal may be only dried in a first stage and then, in a second stage, heated or preheated to a temperature beyond the drying temperature.

The contact of the fine coal with the hot gas may take place in a current having the same direction, or in a countercurrent. Flash driers, for example, or other driers may be employed for drying. In any case, the hot gases brought into contact with the fine coal must be separated again from the coal, in devices known per se, and, prior to discharging the gases. Such devices are loaded with the water content of the charge coal from the drying circuit, and discharged into the free atmosphere. The fine coal dust is separated therefrom with the aid of cyclones, filters, or also electrical precipitators. But only this part requires a careful treatment. The part recycled into the drying plant does not require such an expensive treatment.

The predried coal is transported to the hoppers of the oven chambers either mechanically, by means of band conveyors or scraper flight conveyors, so-called drag-link conveyors, or by hopper cars, or pneumatically, by a gas stream, for example steam, and charged into the chambers. In this way, in general, a bulk weight is obtained which is necessary for producing a good coke. There is no need for the usual levelling of the coal charge in the chamber. Then, the carbonization starts and the coal yields all volatile matter to the outgoing coke oven gas. This gas has now a relatively low content of water vapor, since the moisture water of the coal has not been introduced into the oven chamber and the remaining water vapor content is due to the setting free of the water trapped in the capillary spaces of the coal grains or bonded physically, or it is due to chemical dehydration reactions of the coal constituents under the influence of heat. Consequently, such a coke oven gas has a water vapor content of about 15% by volume, while coke oven gases of non predried coals having a moisture content of approximately 10% may contain up to 40% of water vapor. Because of the considerable heat of vaporization of water, coke oven gas from moist coals has a relatively high heat capacity, and gas from predried coals has a low heat capacity. The difference of the heat capacity results from the smaller heat absorption of the chamber content of predried coals, because of the lack of water evaporation.

The crude coke oven gases pass from the oven chamber through the risers and bends to the gas offtake main where they are sprayed with water, cooled, and condensed. Thereby, the coal or coke dust entrained during the charging and the carbonization is also washed out from the coke oven gases. With the charge of predried coal, the amount of dust is usually about 1.5 to 2.5% of the coal charge.

Irrespective of whether moist or predried coal is charged, the crude coke oven gas escapes from the oven chamber through the risers with a temperature of about 800° C. In the offtake main, upon spraying with water, the water saturation of the gas from moist coal is obtained at about 82°–85° C. and the heat capacity of the gas is so high that if, for example, the offtake main is casually cooled down by rain, the temperature drops insignificantly by some degrees, depending on the season, for example, by about 5° C. For this reason, there has been no need for insulating the offtake main. The temperature of the liquors separated in the main are approximately balanced with the temperature of the gas. The liquor in the offtake main consists substantially of the spray water, the water from the coal, the tars and tar oils. At 82° to 85° C., the viscosity of the tar with the tar oils is such that it drains without difficulties from the main and can be smoothly separated from the water in separators, except for a residue of about 1 to 2%.

If predried coal is charged into the oven chambers, a drier gas with a lower heat capacity is obtained, as mentioned above. Upon spraying with water in the offtake main, this gas also approaches closely the saturation point; for the above-mentioned reasons, however, it is cooled down more than the gas from non-predried coals, and in general, its temperature is lower by about 10° C., i.e. about 75° C. By reason of the lower heat capacity of the gas, the cooling of the offtake main from the outside for example by rain has much greater influence. In such events, the gas temperature drops approximately by 25° C., to about 50° C., depending on the circumstances. It will be understood that these temperature effects also vary with the season. At temperatures below 75° C., the viscosity of the tar begins to considerably increase and, in consequence, it becomes increasingly difficult to separate the tar from the water. Another cause of the difficult separation is the higher content in the tar and water of solid matter, namely coal, coke, and ash particles. It is also of importance that the temperature-dependent densities of tar and water overlap each other in the temperature range of 50°–70° and become approximately equal, which is another obstacle for a smooth separation.

It follows from the foregoing that at the gas treatment side, disadvantages and difficulties stand opposed to the advantages of operating a coke oven battery with predried or preheated coking coals, which are not encountered, or occur only to a smaller extent, if moist coals are used.

SUMMARY OF THE INVENTION

The present invention is directed to a solution of these problems connected to the use of predried coal, namely to a method in which it is not necessary to compensate the advantages of operating the oven chambers with predried coal, such as the possibility of using coals which otherwise are not carbonizable, and the reduction of the coking time, with disadvantages in the gas treatment.

To this end, a method of the above-mentioned kind is provided in which a steam amount corresponding approximately to the amount of water removed from the charge coals during the predrying process is added to the coke oven gases in the gas-offtake main and/or in the suction line of the gas exhauster, in order to thereby increase the heat capacity of the crude coke oven gas and, to the effect as mentioned above, to increase the thermal and mechanical stability of the following gas treatment operation to an extent comparable with a treatment of coke oven gas from moist fine coals.

Due to the invention, it is obtained that the coke oven gas in the offtake main is approximately saturated with steam even if it is produced from predried charge coals, and takes a temperature of about 80° to 85° C., that this temperature is substantially maintained even against influence from the outside, and that the simplicity of separating tar and water becomes equal to that resulting from the use of moist coal.

In accordance with the invention, the advantages of using predried coal are combined with those of using moist coal.

It is well known to add steam through nozzles into the rising mains. This, however, is done in order to adjust a pressure drop of the gas current while charging the coal into the oven chambers and during the carbonization and, as compared to the inventive provision, the amount of the added steam is extremely small.

While controlling the amount of added steam, any heat capacity of the coke oven gas can be adjusted, within limits.

Superheated steam may also be added.

The steam can be supplied from any source, particularly waste steam may be used. A particularly economical variant of the invention provides that the predrying itself of the coal is effected in a circulated steam atmosphere which is indirectly superheated, and that the steam portion obtained from the moist coal is removed from the circuit and, upon separating the coal dust in cyclones, filters, and/or electrical separators, the whole amount or only a part of the steam is directed into the offtake main and/or the suction line of the gas exhauster. However, care is to be taken to prevent the superheated drying steam from getting supersaturated by absorbing the moisture of the coal.

Frequently, the coke oven gas is not used in its original composition, but mixed with inert gases, to reduce its specific calorific value. In such a case, the predrying of the coal may also take place in a circuit of a hot inert gas which is produced by burning some solid, liquid, or gaseous fuel. Also, only a part of this inert gas may be circulated. The gas to be removed, containing the water of the charge coal, is dedusted in cyclones, filters, and/or electrical separators and, in accordance with the invention, returned into the offtake main, in its whole amount or only partly, depending on the desired thermal capacity of the gas and on the temperature of the final condensate, as well as on the desired specific calorific value of the gas. In this variant of the method, it is necessary to adequately design the gas treating equipment, in accordance with the large amount of gas.

This method becomes particularly economical if the coke quenching heat is utilized for the predrying of the coal, in which case the coal drying circuit may be united with the coke quenching circuit to a single circuit, according to German Offenlegungsschrift No. 2,415,758.

The loading with dust of the offtake main is increased in this novel method only to an unimportant extent. Thus, for example, the dust load from the oven chambers of the offtake main of a coke oven battery in operation with predried coal and preheating, which contributes to the dust formation, amounts during and after the charging, converted, to a 1,800 to 2,000 kgs of coal dust per hour, while only 10 kgs per hour are introduced in addition from the preheating plant. This load in excess is insignificant.

It is possible, in accordance with the invention, to operate a coke oven battery with a predrying or preheating plant in a manner such as to prevent any dust emission from the drying or preheating plant, since this plant is not provided with a waste gas outlet of its own to the outside atmosphere. Thereby, filters, cyclones, and pipings are saved.

Accordingly it is an object of the invention to provide a method of operating coke oven batteries arranged in a battery in connection with a predrying or preheating plant for the coal to be coked which comprises predrying and preheating moist coke oven charge coal by bringing it into contact with a circulated current of hot inert gas to remove water from the charge coal and wherein the inert gas comprises a gas containing only a small amount of oxygen and the remainder comprising nitrogen, carbon dioxide and steam and by thereafter charging the preheated and predried coal into a coke oven and directing the coke oven gases generated in the coke oven out to an offtake and adding an amount of steam to the offtake which corresponds approximately to the amount of water removed from the charge coal during the preheating and predrying.

A further object of the invention is to provide a device for preheating and predrying coal associated with a coke oven which includes means for heating steam and directing it into association with coal which is passed successively through a primary flash dryer and a flash heater through which the heated steam is directed and circulating the coal after it has been heated and predried into a coke oven and which also includes means for removing gases from the coke oven and for adding steam to the gases.

A further object of the invention is to provide an apparatus for preheating and predrying coals which are delivered to coke ovens in a closed circuit which is simple in design, rugged in construction and economical to manufacture, The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

GENERAL DESCRIPTION OF THE PREFERRED EMBODIMENTS

Figure 1:
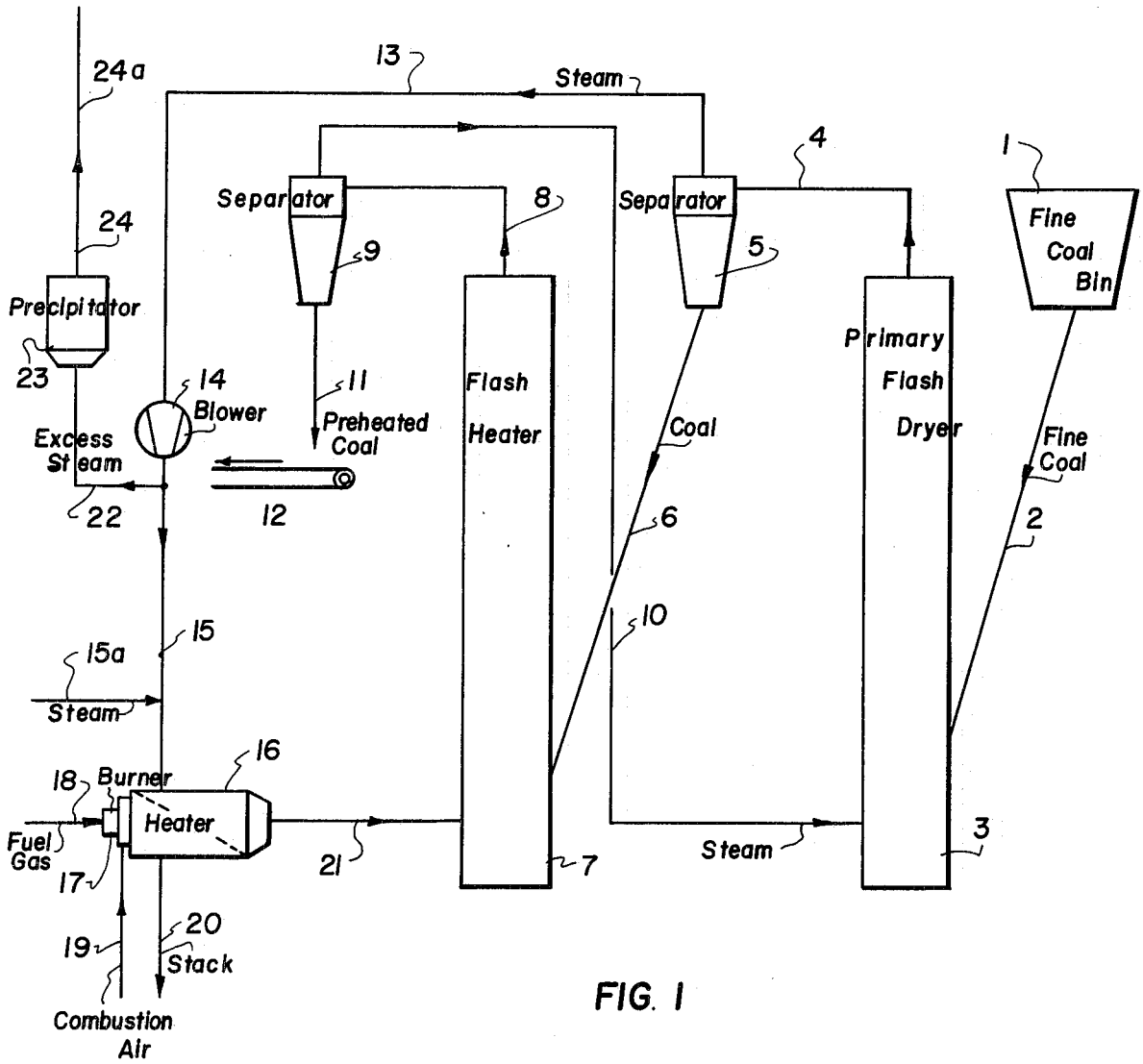
FIG. 1 is a diagrammatic showing of a predrying portion of a battery for treating coal for use in a coke oven in accordance with the invention.

Referring to the drawings in particular the invention embodied therein comprises a closed steam system for the preheating of fine coal which is delivered from a coal bin 1 through a fine coal delivery line 2 into a primary flash dryer 3.

As carrier gas for the fine coal, steam is used which, at the start of the operation, is supplied through a line 15*a* (FIG. 1) into a line 15 and superheated in a heater 16. The necessary heat is produced in heater 16 by burning a fuel gas which is supplied to a burner 17 through a line 18. Burner 17 receives combustion air through a line 19 while the burnt waste gases are evacuated through a stack 20. The superheated steam is blown through a line 21 into the bottom part of a flash heater 7, and it heats and carries upwardly the predried coal fed in through a line 6. Steam and coal are discharged through a line 8 and separated from each other in a secondary cyclone 9. The steam is supplied through a line 10 into the bottom part of a primary flash drier stage 3 where it dries the fine coal fed in through a line 2 from a bin 1, and carries it upwardly. Through a line 4, steam and coal are discharged and separated from each other in a primary cyclone 5.

The steam is supplied through a line 13 to a blower 14 by which it is recycled through line 15 to heater 16. Thereby, the steam circuit is closed. Steam in excess is removed from the circuit through a line 22, dedusted in an electrical precipitator 23, and supplied through a line 24 to the coke oven battery.

Figure 2:
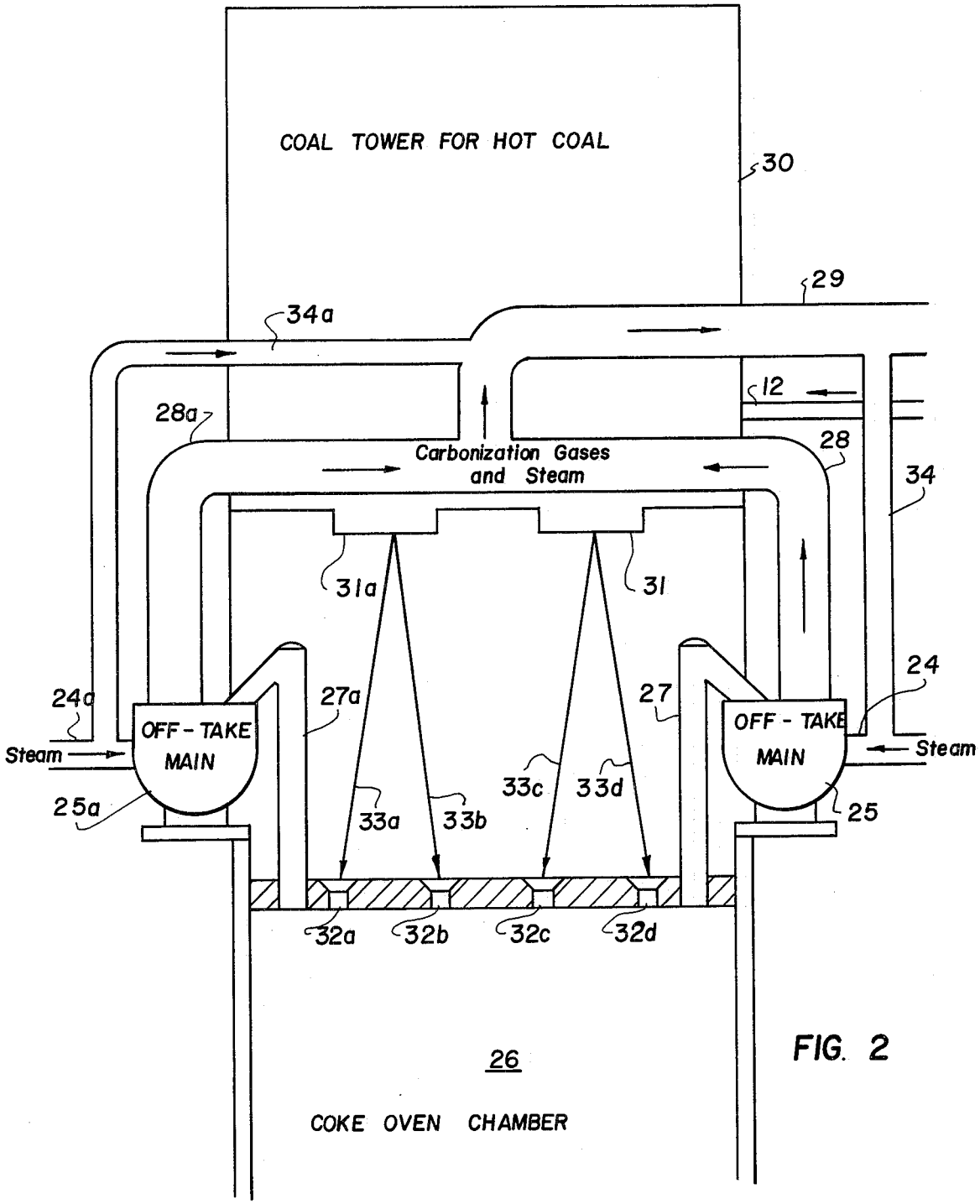
FIG. 2 is a schematic showing of the direction of the predried coal into the coke oven and for the treatment of the coke oven gases which are formed thereby in accordance with the invention.

The predried and preheated coal is removed from secondary cyclone 9 through a downpipe 11 and supplied to a coal tower 30 for hot coal (FIG. 2), by means of an enclosed conveyor 12 which is kept under inert atmosphere. From coal tower 30, the hot coal is removed through ducts 31 and 31*a* and charged, through known equipment 33*a* to 33*d*, for example such as disclosed in German Pat. No. 2,239,557 or German Offenlegungsschrift Nos. 2,336,515 and 2,514,859, and through hoppers 32*a* to 32*d*, into oven chambers 26 of the coke oven battery.

The hot gases produced during the carbonization pass from oven chambers 26 through risers 27 and 27*a* into the water-sprayed (not shown) gas offtake mains 25 and 25*a* where condensates precipitate. From line 24, FIG. 1, through which the steam in excess of the predrying and preheating process is evacuated, a line 24*a* is branched off (FIG. 2), and lines 24 and 24*a* open into the takeoff mains 25 and 25*a* where the water removed in the predrying plant from the moist coal is admixed as steam to the carbonization gases. The carbonization gases enriched with steam pass through lines 28 and 28*a* into a suction line 29 at the end of which a gas exhauster (not shown) is provided. Through bypass lines 34 and 34*a*, a part of the steam may also be taken into suction line 29 from lines 24 and 24*a* directly, in instances where this would prove useful. In addition to the water spray in the offtake main, in view of the pressure conditions.

EXAMPLE FOR COMPARISON

In a well known manner, 125 metric tons per hour of fine coal having a water content of 6% is supplied into the coal predrying and preheating plant of a coke oven battery. The predrying and preheating takes place in a current of 65 metric tons of hot steam having a temperature of 650° C. and a pressure of 1 bar. The hot steam current absorbs the moisture of the coal, and 6 metric tons per hour of hot steam at 150° C. and 1 bar are removed from the steam circuit and freed from dust in cyclones, filters, and finally in an electric precipitator, prior to being discharged into the outside atmosphere. In this process, 10 kgs per hour of solid matter are precipitated. In the coke oven battery, the preheated coal is carbonized whereby 76,000 $Nm^3$ per hour of close to water saturated coke oven gas having a temperature of 75° C. and a dust content of 33 grams per $Nm^3$ are obtained in the offtake main. Now, in accordance with the invention, the steam in excess from the steam circuit of the predrying and preheating plant is no longer discharged into the outside atmosphere, but blown, through a connecting line (24, 24*a* in FIGS. 1 and 2) into the offtake mains (25, 25*a*) of the coke oven battery. As a result, 96,000 $Nm^3$ per hour of water-saturated coke oven gas are obtained in the offtake main, having a solid matter content of 26 grams per $Nm^3$ and a temperature of 82° C.

While specific embodiments of the invention have been shown and described in detail to illustrate the application of the principles of the invention, it will be understood that the invention may be embodied otherwise without departing from such principles.

What is claimed is:

1. A method of operating a coke oven battery in connection with a plant for predrying and preheating a coal to be coked, comprising preheating and/or predrying moist coke oven charge coal by bringing it into contact with a current of hot inert gas to remove water from the charge coal, and with the inert gas comprising a gas containing only a small amount of oxygen and the balance of nitrogen, carbon dioxide and steam, charging the preheated and/or predried coal into the coke oven for heating the coal to form coke and coke oven gases, directing the coke oven gases generated in the coke oven out through an offtake, and adding an amount of steam to the offtake which corresponds approximately to the amount of water removed from the charge coals during preheating and/or predrying.

2. A method according to claim 1, wherein superheated steam is added to the coke oven gases.

3. A method according to claim 1, wherein the predrying and preheating of the coal is carried out in a closed steam cycle wherein the steam is heated to superheated steam and circulated through at least one flash heater along with the moist coal which is heated and dried by the steam and thereafter delivered to the coke oven; and wherein the steam is collected and circulated back to the heater for reheating; and wherein an excess portion of the steam is tapped from a closed cycle and directed into the offtake.

4. A method according to claim 1 wherein the inert gas is produced by burning a solid, liquid or gaseous fuel and at least a part of the inert gas is circulated in contact with the coal to preheat and predry it and thereafter passed through a separator to remove coal dust and thereafter directed into the offtake mains.

5. A method according to claim 1, wherein coke which is formed in the coke oven is quenched and wherein the heat of the quenching is used for predrying the coal.

6. A method according to claim 5, wherein the quenching circuit is united with the coal drying circuit.

* * * * *